US005241942A

United States Patent [19]

Heritier-Best et al.

[11] Patent Number: 5,241,942

[45] Date of Patent: Sep. 7, 1993

[54] METHOD FOR INSTALLING A PLURALITY OF IGNITION COILS ON AN ENGINE BLOCK, AND ELECTRICAL POWER SUPPLY ASSEMBLY FOR EMPLOYING THE METHOD

[75] Inventors: Pierre Heritier-Best, Orbeil; Denis Plantin, Brassac les Mines, both of France

[73] Assignee: Sagem Allumage, Paris, France

[21] Appl. No.: 846,508

[22] Filed: Mar. 6, 1992

[30] Foreign Application Priority Data

Mar. 7, 1991 [FR] France ..... 91 02730

[51] Int. Cl.[5] ..... F02P 17/00

[52] U.S. Cl. ..... 123/635; 123/647

[58] Field of Search ..... 123/635, 647, 594, 634; 315/209 T, 57, 266; 427/213.3; 264/4, 4.1

[56] References Cited

U.S. PATENT DOCUMENTS

| | | | |
|---|---|---|---|
| 4,195,611 | 4/1980 | Worz et al. | 123/635 |
| 4,198,943 | 4/1980 | Worz | 123/647 |
| 4,392,473 | 7/1983 | Tsutsui et al. | 123/635 |
| 4,706,638 | 11/1987 | Johansson et al. | 123/635 |
| 4,706,639 | 11/1987 | Boyer et al. | 123/647 |
| 4,834,056 | 5/1989 | Kawai | 123/635 |
| 4,903,675 | 2/1990 | Huntzinger et al. | 123/635 |

FOREIGN PATENT DOCUMENTS

| | | | |
|---|---|---|---|
| 0387993 | 9/1990 | European Pat. Off. | 123/635 |
| 8500930 | 2/1985 | PCT Int'l Appl. | 123/635 |
| 2173047 | 10/1986 | United Kingdom | 123/635 |

*Primary Examiner*—Raymond A. Nelli

*Attorney, Agent, or Firm*—Dennison, Meserole, Pollack & Scheiner

[57] ABSTRACT

A method and assembly for installing a plurality of ignition coils (12) on an engine block. The invention includes molding a housing (1) from an electrically insulating material. The housing having a plurality of receptacles (4) for the coils and including inserts for attachment of the housing to the engine block. The coils are placed in receptacles with appropriate wiring, and the connections (23, 24) of the receptacles are connected to the primary and secondary windings of the coils. When all connections are made, an electrically insulating resin (25) is poured into the housing which embeds the coils and their cable connections. Finally, the housing is fixed on the engine block with the appropriate receptacle properly aligned with its respective sparkplug.

8 Claims, 4 Drawing Sheets

METHOD FOR INSTALLING A PLURALITY OF IGNITION COILS ON AN ENGINE BLOCK, AND ELECTRICAL POWER SUPPLY ASSEMBLY FOR EMPLOYING THE METHOD

BACKGROUND OF THE INVENTION

1. Field of the Invention

The present invention relates to a method of installing a plurality of ignition coils on an engine block, and an electrical power supply assembly for employing this method.

It is already known, for the sale of reducing the length of the high-voltage cables between a single ignition coil and the various spark plugs of an internal combustion engine, to dispose an individual coil in the immediate proximity of the spark plugs.

However, this arrangement has the disadvantage of multiplying the number of components and consequently the complexity of the installation operations.

It is also known to use only a single coil for two spark plugs, with this coil having each end of its secondary winding connected to one of the two spark plugs, with ignition occurring only at the desired spark plug for reasons of electrical conductivity of the gases in the respective cylinders.

Although this arrangement effectively makes it possible to reduce the number of coils, it does not further simplify the installation operations, because it requires more-complex high-voltage cable connections.

The present invention seeks to overcome these disadvantages.

SUMMARY OF THE INVENTION

To this end, the present invention relates first to a method for installing a plurality of ignition coils on an engine block, characterized in that it includes the following steps:

molding from an electrically insulating material a housing forming a plurality of receptacles for said coils and including means, in the form of inserts, for attachment of said housing to said engine block;

putting said coils in place in said receptacles;

wiring the connections to the primary and secondary windings of said coils;

pouring an electrically insulating resin into the housing, embedding said coils and their cable connections; and fixing the housing on said engine block.

More particularly, the method of the invention may include the following steps:

installing in said housing, before the resin is put in place, a connection for power supply to the primary windings of said coils and pins for connected to the spark plugs of said engine block; and wiring the low-voltage connections between said connector and the primary windings of the coils, on the one hand, and the high-voltage connections between the secondary windings of the coils and said connection pins, on the other.

Thanks to the method of the invention, it is possible to make an integral-cast assembly including the coils and their cable connections retained in the housing by the insulating resin, this housing then being installed on the engine block in a single operation.

The method of the invention consequently has the advantages of multiple-coil arrangements, while maintaining very great simplicity of installation.

It is also possible to include in the housing, in the form of inserts, the magnetic circuits of the coils on the periphery of the receptacles of these coils.

The subject of the present invention is also an assembly for electrical power supply to the spark plugs of an engine block, characterized in that it includes the following:

a housing forming a plurality of receptacles and made of an electrically insulating material, in which means, in the form of inserts, are included for attachment of the housing to said engine block;

a plurality of coils disposed in said receptacles;

the cable connections of said coils; and an electrically insulating resin embedding said coils and their cable connections.

More particularly, the assembly according to the invention may include an electrical power connector connected via low-voltage wired connections to the primary winding of said coils, said connector also being embedded in said resin.

The assembly according to the invention may also include passages for supplying air to said engine block, said electrical power supply connector being embodied in one piece with a connector for supplying air to said passages.

In order to limit the quantity of resin used and possibly to define the aforementioned air supply passages, the cable connections are preferably disposed in conduits defined by ribs of the housing.

In the case of an assembly intended for a four-cylinder engine and including only two ignition coils, the secondary winding of each of the coils is connected by each of its ends to one pin for connection to one of the spark plugs of the engine.

The housing further may also include, in the form of inserts, the magnetic circuits of said coils disposed on the periphery of the receptacles of these coils.

By way of non-limiting example, a particular embodiment of the invention will now be described in conjunction with the accompanying schematic drawings, in which:

DESCRIPTION OF THE INVENTION

Figure 1:
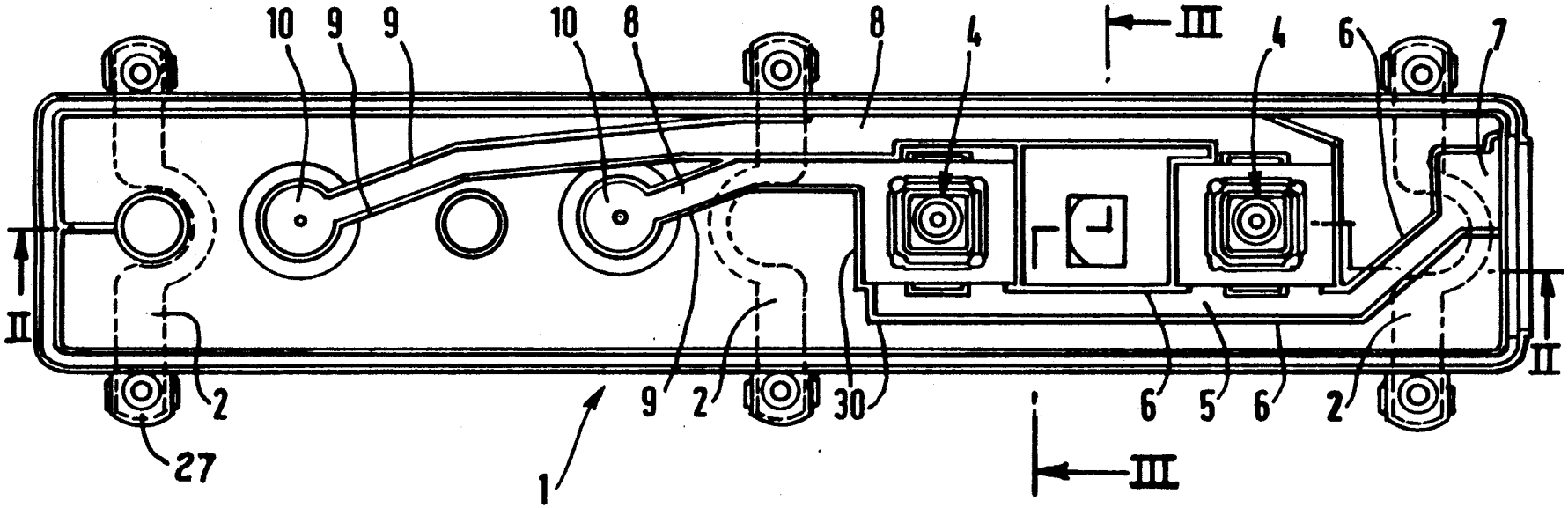
FIG. 1 is a plan view of the housing according to the invention.
Figure 2:
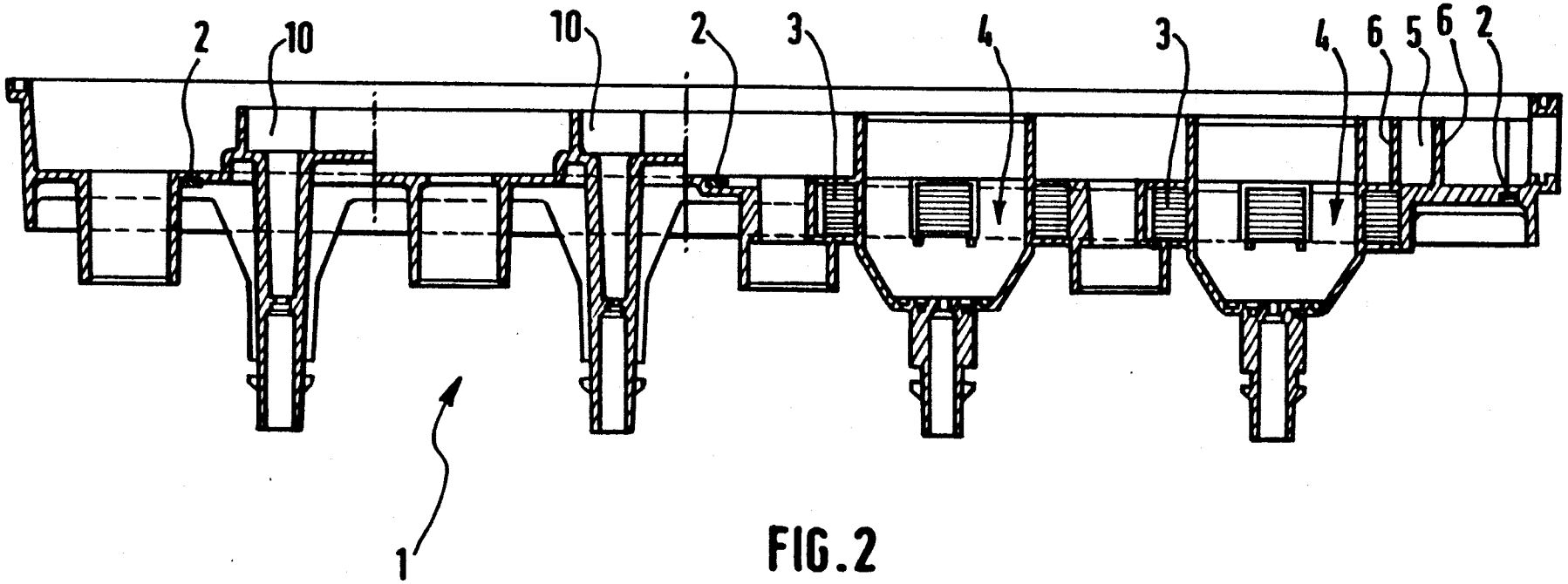
FIG. 2 is a sectional view taken along the line II—II of FIG. 1.
Figure 5:
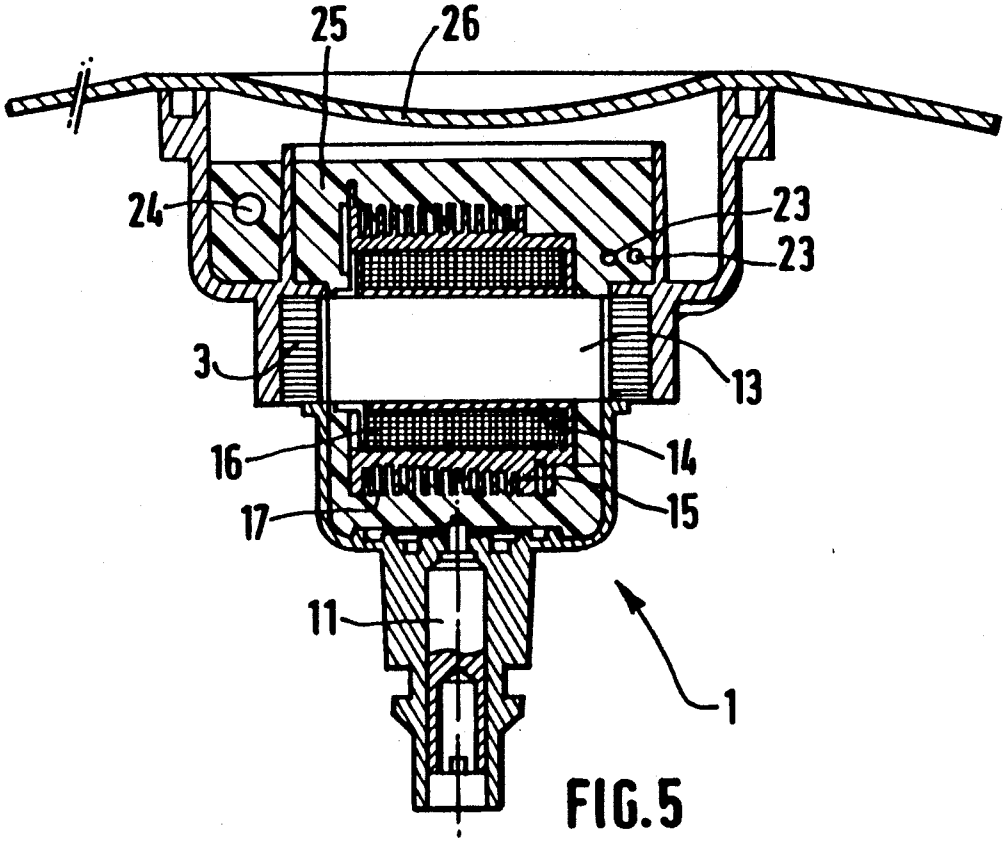
FIG. 5 is a sectional view taken along the line V—V after the resin has been put in place.
Figure 3:
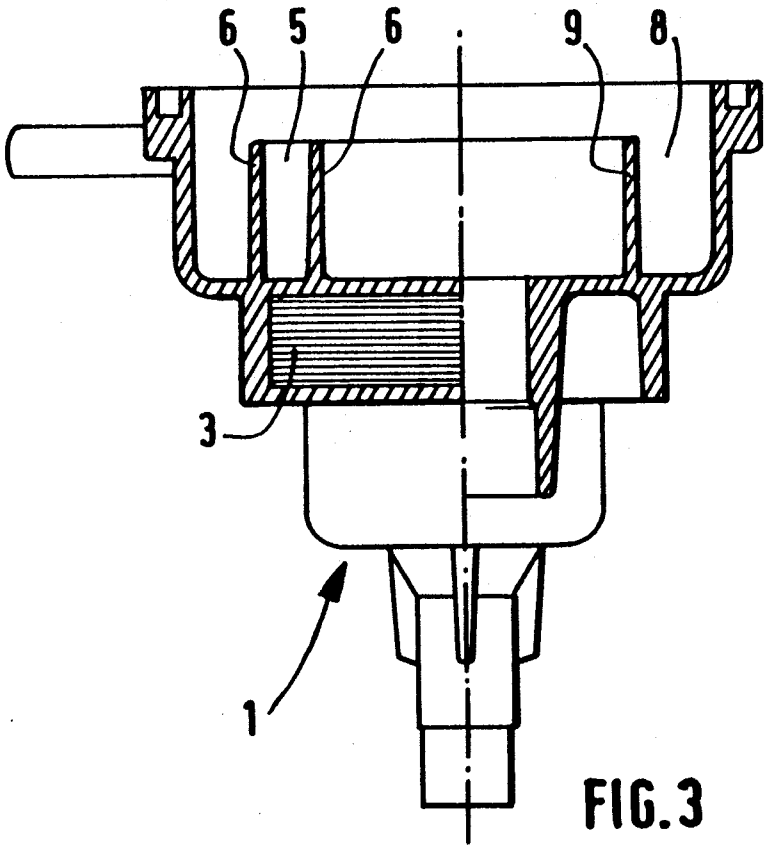
FIG. 3 is a sectional view taken along the line III—III of FIG. 1.
Figure 4:
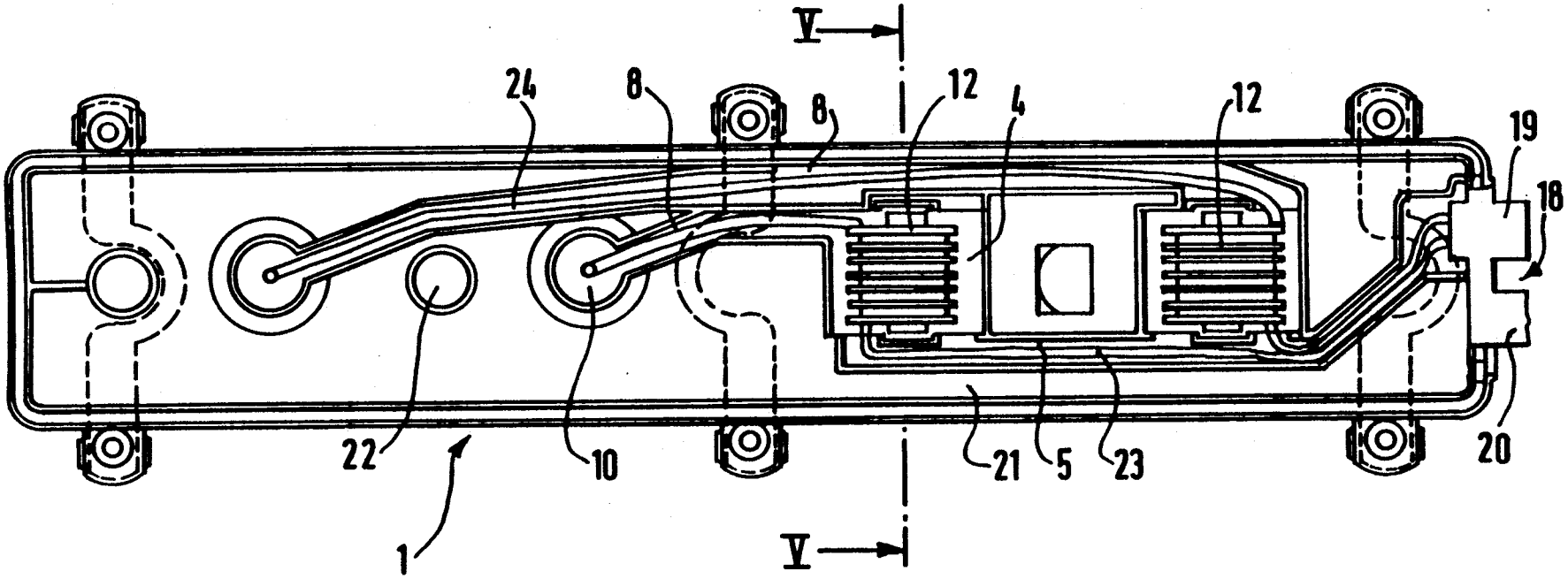
FIG. 4 is a plan view of the assembly according to the invention before the resin is put in place.

As shown in FIG. 1, the housing 1, seen from above, has an elongated rectangular shape. In the present case, this housing is provided to accommodate two coils with two outputs, and is consequently intended for a four-cylinder engine.

This housing is molded in one piece from an insulating plastic material and embedded in this plastic material it includes inserts 2 for its attachment to the engine block, along with the magnetic circuits 3 of the coils.

The housing 1 forms receptacles 4 for the coils, inside the two magnetic circuits 3.

Via a conduit 5 defined by ribs 6, the receptacles 4 are connected to a receptacle 7 opening to the outside of the housing for receiving the linking connections for power supply to the primary windings of the coils.

Since after installation of the housing on the engine block, the receptacles 4 are located directly above two of the spark plugs of this engine, they are connected via conduits 8, defined by ribs 9, to receptacles 10, which after installation of the housing on the engine block are located immediately above the other two spark plugs.

After the housing 1 that has just been described has been molded, pins 11 are disposed on the bottom of the receptacles 4 and 10 to assure the electrical connection of the spark plugs of the engine to the ends of the secondary windings of the coils.

These coils are then in turn put in place in the receptacles 4 of the housing 1.

These coils, in a known manner, are composed of a core 13 on which the primary winding tube 14 and the secondary winding tube 15 are placed. The primary winding 16 is wound onto the tube 14, and the secondary winding 17 is wound onto the tube 15.

The coils 12 are placed in the receptacles 4 in such a way that the cores 13 are located facing the magnetic return circuits 3.

A connector 18 is then placed in the receptacle 7. This connector 18 includes an electrical connector 19 and an air conduit 20, which are embodied in one piece. After being put in place, the conduit 20 is connected to air passages 21 intended for supplying the air to the engine block by way of openings 22.

The electrical connector 19 is connected via low-voltage connections 23 to the primary windings 16 of the coils 12, while the ends of the secondary windings 17 of the coils are connected to the pins 11.

One of the ends of each secondary winding is connected directly to the pin 11 of its receptacle 4, while the other end is connected to a pin of one of the receptacles 10 via a high-voltage cable 24.

The low-voltage supply wires 23 are disposed in the conduit 5, and the high-voltage cables 24 are disposed in the conduits 8.

Once the wiring connections have been completed, an electrically insulating resin 25 is poured into the receptacles 4, 7 and 10 and into the conduits 5 and 8, thus immobilizing the coils 12 and their wiring connections along with the double connector 18.

A cover 26 is then mounted on the housing 1 by any suitable means.

The assembly thus made is installed in a single operation on the engine block by means of the mounting brackets 27 of the inserts 2. It then suffices to connect the collector 11 to its two supplies of electricity and air, respectively.

It is understood that the invention is equally applicable to an engine including some other number of cylinders than four, and to coils having only a single secondary output.

We claim:

1. A method for manufacturing an assembly for electrical power supply to spark plugs of an engine block, wherein the improvement includes the following steps:

molding from an electrically insulating material a housing;

forming a plurality of receptacles in said housing for primary and secondary windings of coils;

spacing at least some of said plurality of receptacles in said housing to align with the spark plugs of the engine block;

forming a plurality of inserts for attachment of said housing to said engine block;

putting said primary and secondary windings of said coils in place in said receptacles;

wiring low and high voltage connections of said receptacles to the primary and secondary windings of said coils;

pouring an electrically insulating resin into the housing;

embedding with said electrically insulating resin said primary and secondary windings of said coils and their cable connections; and mounting the housing on said engine block.

2. The method of claim 1, including the following steps:

installing in said housing, before the resin is poured in place, a connection (19) for receiving power and supplying to the primary windings (16) of said coils;

installing in said plurality of receptacles pins (11) for connecting to the spark plugs of said engine block; and wiring the low-voltage connections (23) between said connector and the primary windings of the coils, and wiring the high-voltage connections (24) between the secondary windings (17) of the coils and said connections.

3. An assembly for electrical power supply to the spark plugs on an engine block, said assembly comprising:

a molded electrically insulating housing having a plurality of receptacles spaced and formed in said molded electrically insulating housing, each said plurality of receptacles positioned to align with the spark plugs of the engine block;

an opening receptacle formed near one end of said housing for receiving power;

conduit means for connecting said plurality of receptacles and said opening receptacle;

insert means for attachment of the housing to said engine block;

a plurality of coils (12) disposed in said plurality of receptacles, said plurality of coils including a primary winding and a secondary winding;

cable connections extending from said coils for connecting said plurality of coils to said conduit means; and an electrically insulating resin (25) embedding said coils and cable connections, said resin immobilizing said plurality of coils.

4. The assembly of claim 3, including an electrical power connector, said electrical power connector connected to low-voltage wired connections of said primary winding of said coils, said connector also being embedded in said resin.

5. The assembly of claim 4, including passages (21) for supplying air to said engine block, said electrical power supply connector being embodied in one piece with a connector (20) for supplying air to said passages.

6. The assembly of claim 3, in which the cable connections are disposed in said conduits and said conduits are defined by a plurality of ribs (6, 9) of the housing.

7. The assembly of claim 3, wherein the secondary winding of each of the coils being connected to a pin extending from said respective receptacle and said pin for connection to one of the spark plugs of the engine.

8. The assembly of claim 3, in which the housing further includes, in the form of inserts, the magnetic circuits of said coils disposed on the periphery of the receptacles of these coils.

* * * * *